United States Patent [19]

Anderson et al.

[11] 4,047,140

[45] Sept. 6, 1977

[54] THERMAL OVERLOAD RELAY

[75] Inventors: Paul T. Anderson; Stephen S. Dobrosielski, both of Beaver, Pa.

[73] Assignee: Westinghouse Electric Corporation, Pittsburgh, Pa.

[21] Appl. No.: 643,719

[22] Filed: Dec. 23, 1975

[51] Int. Cl.[2] ..... H01H 71/16

[52] U.S. Cl. ..... 337/75; 337/78

[58] Field of Search ..... 337/70, 72, 75, 77, 337/78

[56] References Cited

U.S. PATENT DOCUMENTS

| | | | |
|---|---|---|---|
| 3,108,165 | 10/1963 | Cinibulk | 337/72 X |
| 3,185,793 | 5/1965 | Eilenberger | 337/77 X |
| 3,792,401 | 2/1974 | Anderson | 337/49 |

*Primary Examiner*—George Harris
*Attorney, Agent, or Firm*—L. P. Johns

[57] ABSTRACT

A thermal overload relay characterized by a plurality of pole units, stationary and movable contacts, a slide within the housing for moving the movable contact between open and closed positions, a movable contact mounting arm on the slide, latch means on the slide for latching the slide in one of said positions, resetting means for moving the slides to the latched position, each pole comprising a bimetal element responsive to current flow to effect heating thereof, a crossbar associated with the bimetal element to effect unlatching of the latch means, and the housing being an integral single unit into which the several foregoing elements are inserted in place.

11 Claims, 7 Drawing Figures

THERMAL OVERLOAD RELAY

BACKGROUND OF THE INVENTION

1. Field of the Invention:

This invention relates to an electric control device and more particularly it pertains to a thermally responsive overload relay.

2. Description of the Prior Art:

Thermal overload relays of the type used to protect an electric motor are known in the art. Examples of patents disclosing such relays are U.S. Pat. Nos. 3,265,831, 3,792,401, and 3,842,383. From time to time, economic factors such as cost of materials and competing products require a consideration of cost-cutting measures without sacrificing quality. Indeed, some prior existing overload relays having reliability and endurance have been too costly and awkward when replacing worn-out or broken parts.

SUMMARY OF THE INVENTION

It has been found in accordance with this invention that foregoing problems may be overcome by providing a thermal overload relay having an integral housing comprising a single molded unit on which the several operating parts are attached, the relay also comprising a plurality of pole units, a stationary contact, a movable contact, a slide within the housing for moving the movable contact between open and closed positions, a movable contact mounting arm on the slide, a latch lever having a detent releasably latching the slide in the closed position, an inclined plane on the housing disposed in the path of travel of the mounting arm to effect movement of the movable contact from the stationary contact when the slide moves to the open position, the mounting arm and the latch lever being spring-biased away from each other, a manually reset rod having one end engageable with the mounting to effect movement of the slide to a position where the detent is latched, the mounting arm in the open position being in the path of travel of the reset rod to enable movement of the arm to a reset position, the reset rod and the mounting arm having interlocking surfaces to effect non-contact of the stationary and movable contacts when the detent is prevented from relatching by the bimetal element of at least one of the pole units.

The advantage of the device of this invention is that by providing a single integral housing unit the relay is readily assembled and disassembled such as by the insertion of a crossbar and a reset rod by a snap-fit insertion during assembly, which elements are inserted into or removed from one or the other end of the housing into molded openings formed therein.

DESCRIPTION OF THE PREFERRED EMBODIMENT

Figure 1:
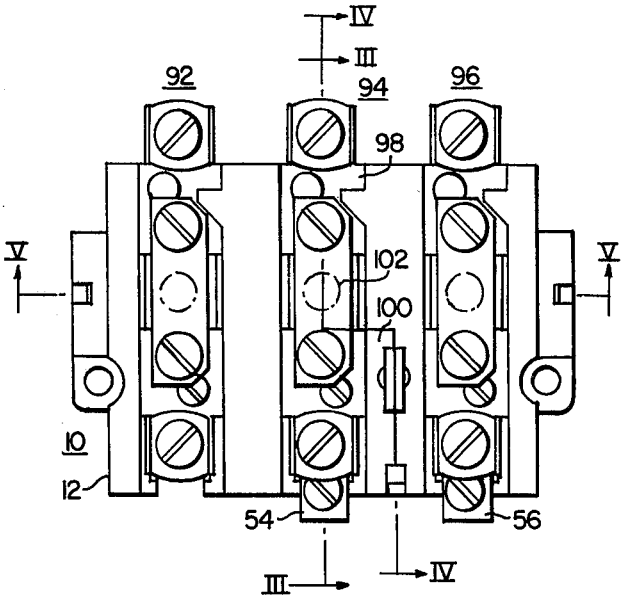
FIG. 1 is a plan view of the device of this invention.

In the drawings a thermal overload relay is generally indicated at 10. It comprises a housing 12 which is a single integral molded unit composed of an electrically insulating material such as a phenolic resin. As shown more particularly in FIGS. 3, 4 and 5, the molded housing 10 includes a plurality of vertical bores 14, 16, 18, as well as a chamber 20. For insulation, the bores 14, 16, 18 are separated by similar partitions 22 which are molded integrally with the housing 12. A bimetal element 24, 26, 28 is disposed in each bore 14, 16, 18, respectively. The bimetal elements are separately suspended at their upper ends. For that purpose, a hanger 30 extends across each bore 16 with opposite end portions 32 secured in suitable notches in the housing. Each hanger 30 includes an out-turned flange 34 which extends through an opening 36 in each bimetal element. The upper end portion of each bimetal element is thereby clamped between the hanger 30 and a surface 38 of the housing so that when the bimetal is heated the lower end portion 40 moves to the right as viewed in FIG. 3 and moves a crossbar 42 in the same direction.

Figure 5:
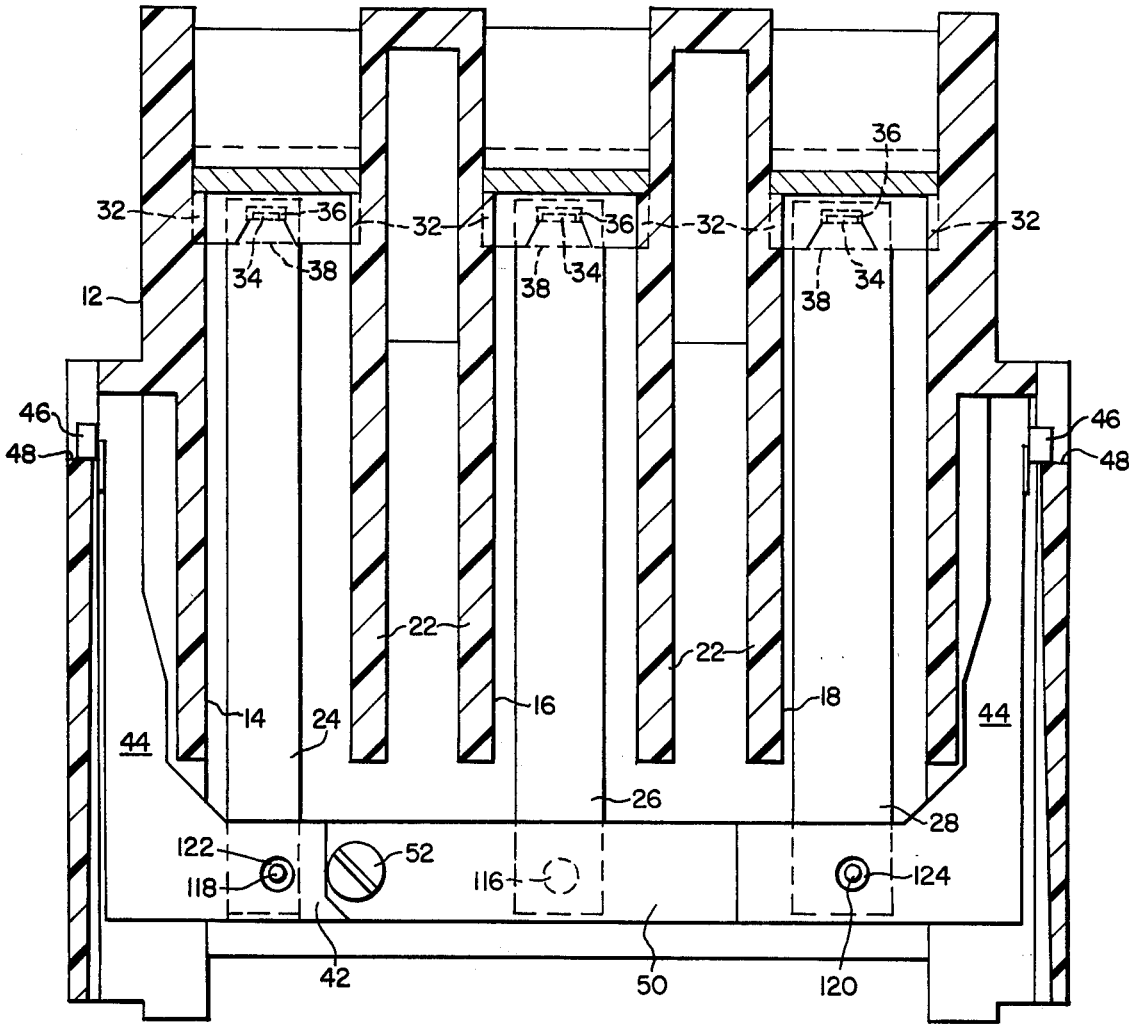
FIG. 5 is a vertical sectional view taken on the line V—V of FIG. 1.

As shown in FIG. 5, the crossbar 42 is a U-shaped member having similar up-turned end portions 44 with outturned trunnions 46 extending into notches 48 in the housing. Thus, the crossbar 42 is free to move pivotally on the trunnions. The crossbar 42 is composed of a dielectric material similar to that of the housing 12. In addition, the crossbar 42 is provided with a compensating bimetal 50, which is attached by a screw 52.

Figure 2:
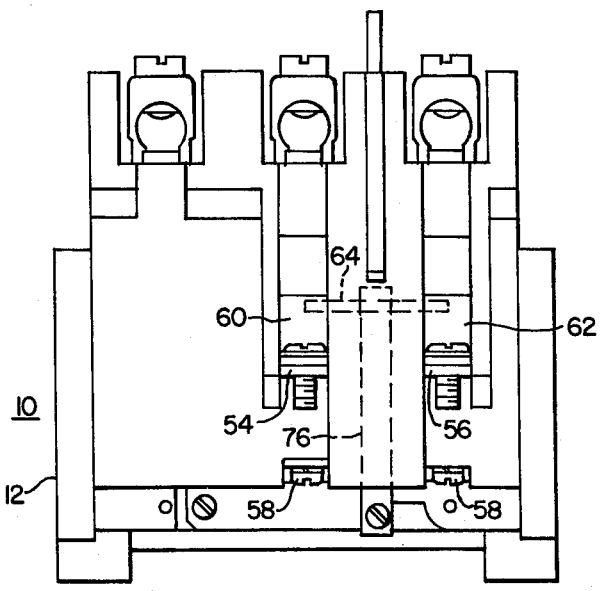
FIG. 2 is a front elevational view of the device.
Figure 3:
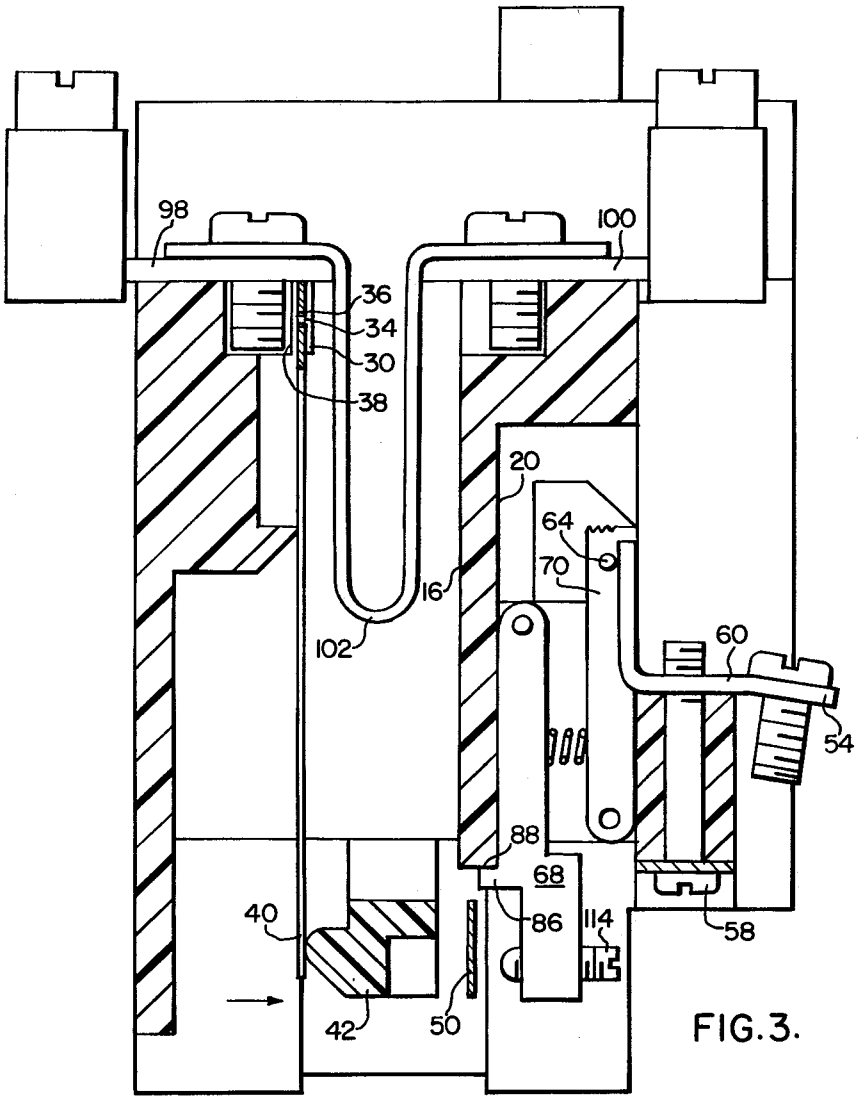
FIG. 3 is a vertical sectional view taken on the line III—III of FIG. 1.

In accordance with this invention, the relay 10 comprises an operating mechanism for opening a circuit through a pair of terminals 54, 56, which are connected by suitable leads (not shown) to a coil of an electromagnetic contactor of the type shown in U.S. Pat. No. 3,339,161, issued August 29, 1976 to J. P. Conner et al, assigned to the same assignee as this application. As shown in FIGS. 2 and 3, the terminals 54 and 56 are mounted by similar screws 58 and comprise L-shaped terminal straps 60, 62, respectively, the inner ends of which comprise stationary contacts which are engaged by a bridging movable contact 64. The operating mechanism comprises a movable block or slide 66, a latch lever 68, and a movable contact mounting arm 70, all of which are located within the chamber 20.

Figure 6:
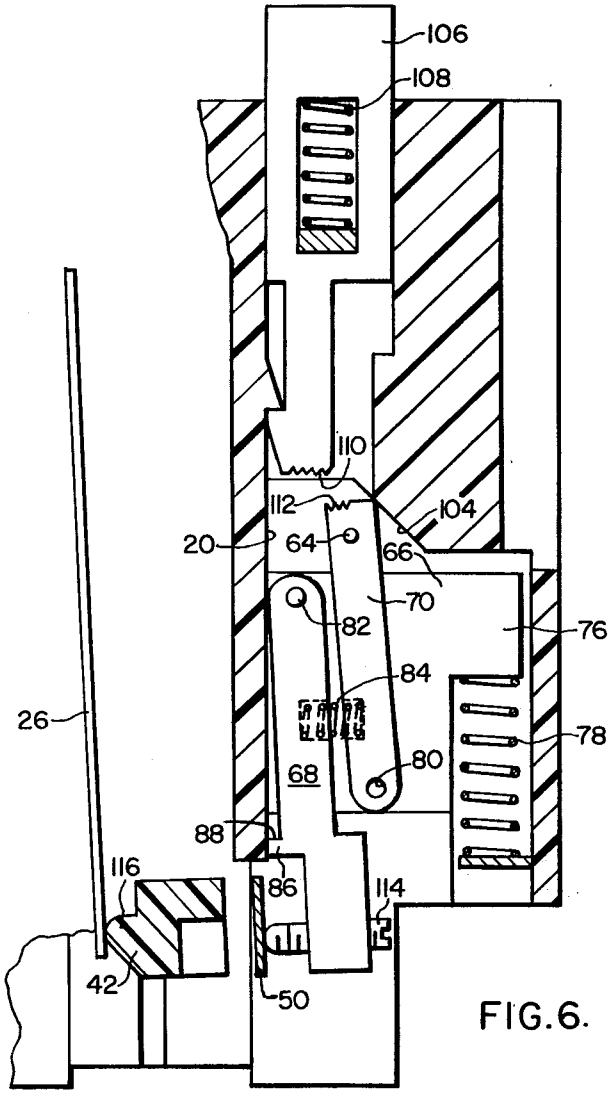

The slide 66 is slidable on opposite interior walls 72, 74 of the chamber 20 and includes a projecting portion 76 which, in cooperation with a compression spring 78, biases the slide 66 upwardly to the unlatched or open contact position of FIG. 6. The mounting arm 70 is pivotally mounted on the slide 66 at pivot pin 80 and the latched arm 68 is pivotally mounted on the slide by pivot pin 82. The arm 70 and the lever 68 are mounted on the same sides of the slide and a spring 84 is disposed between them to hold the pins away from each other. The latch lever 68 includes a projection or detent 86 having an upper surface 88 which engages the lower end of a housing partition 90 in the latched position of the lever, whereby the movable contact 64 is in the closed position (FIG. 3) with respect to the terminal straps 60, 62. The spring 84 between the arm 70 and the latch lever 68 operate to hold the detent 86 and the movable contact 64 in their respective positions during normal operation of the relay 10.

As shown in FIGS. 1 and 2, the housing 12 supports three longitudinally spaced transversely extending terminals 92, 94, 96 of similar construction. All of the terminals, as shown for terminal 94 by way of example, comprise a pair of spaced conductor straps 98 and 100 and a U-shaped interconnecting heater strap 102. When a normal current passes through the terminals 92, 94, 96, the corresponding bimetal elements 24, 26, 28 remain in the positions shown in the drawings such as FIG. 3, whereby the latch lever 68 remains in the latched position. However, when an overload current such as a motor overcurrent occurs, the U-shaped interconnecting heater strap 102 is heated sufficiently to cause one or more of the associated bimetal elements 24, 26, 28 to flex to the right (FIGS. 3 and 4) to thereby rotate the common crossbar 42 counterclockwise about the trunnions 46. During that movement, the compensating bimetal 50 moves against the latch lever 68 which is rotated counterclockwise to dislodge the detent 86 from the latched position, whereupon (FIG. 6) the spring 78 raises the assembly of the slide 66, and lever 68. As a result, the upper end of the lever slides along an inclined surface 104 of the housing and moves the contact 64 out of contact with the terminal straps 60, 62 and to the open position.

Figure 7:
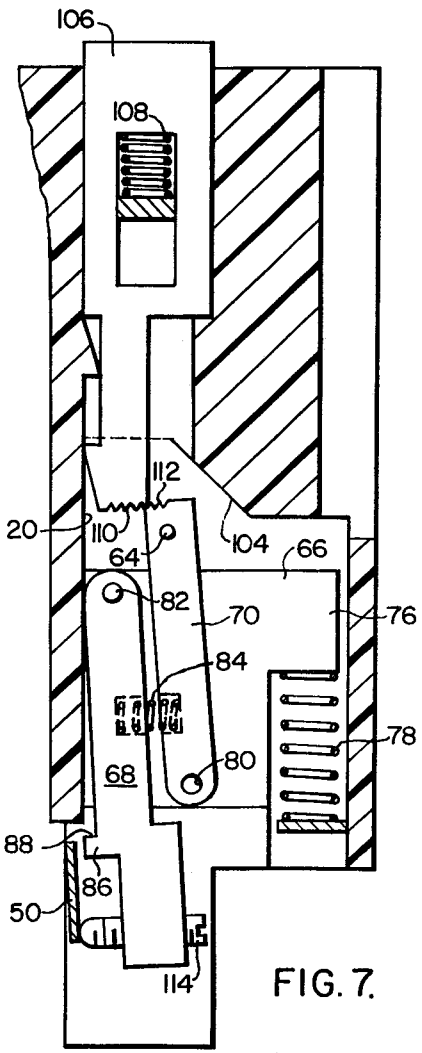
FIGS. 6 and 7 are fragmentary sectional views showing alternate positions of the operating parts.

To reset the relay 10 in accordance with this invention, a reset rod 106 is slidably mounted in the upper end of the chamber 20 where it is biased outwardly by a spring 108. The lower end surface 110 is provided with interlocking means, such as serrations, to engage a corresponding interlocking or serrated edge 112 of the mounting arm 70. As the reset rod 106 is lowered manually, the serrated edge 110 engages the serrated edge 112 and continued lowering of the rod moves the assembly of the slide 66 and the latch arm 68 to a relatch position as shown in FIG. 7. So long as one of the bimetals, such as the bimetal element 26, is in the deflected position, the latch arm 68 remains in the unlatched position so that the detent 86 cannot engage the surface 88, notwithstanding the spring 84. Thus, release of the reset rod 106 permits the spring 78 to return the slide 66 and the arm 70 to the open position of the movable contact 64 as shown in FIG. 6.

Figure 4:
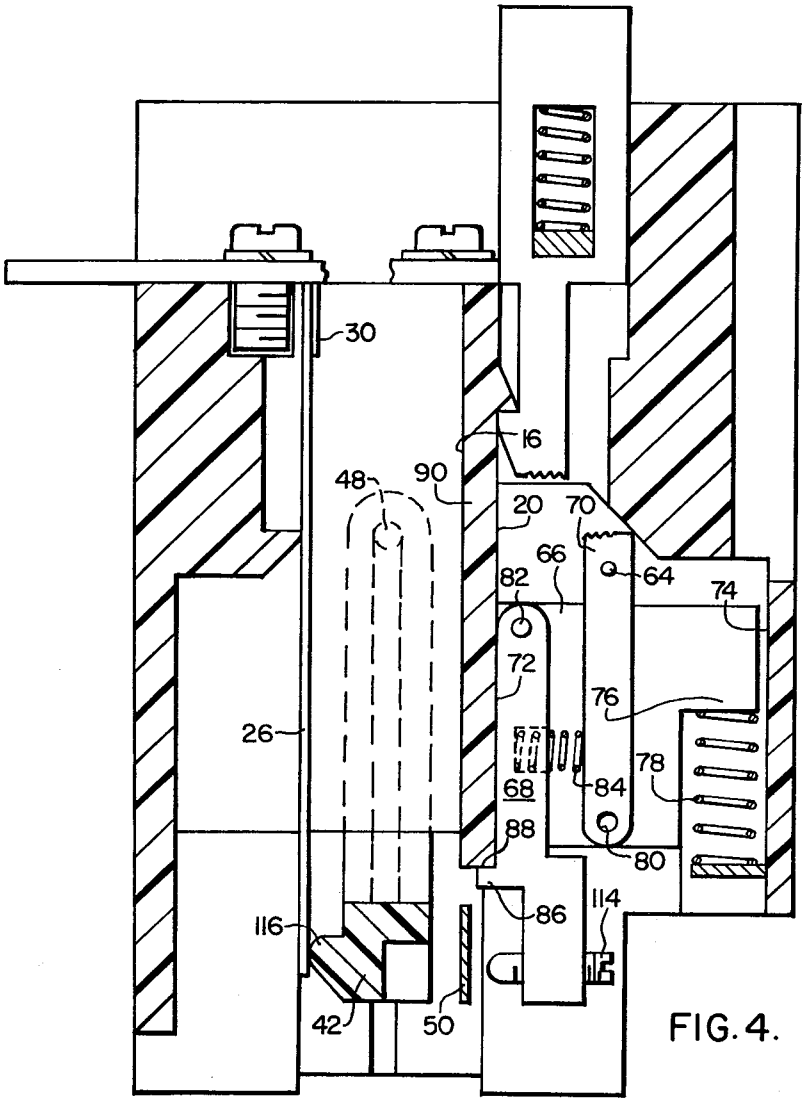
FIG. 4 is a vertical sectional view taken on the line IV—IV of FIG. 1.

When the overload condition which causes deflection of the bimetal element 26 is corrected, the bimetal element returns to the position of FIG. 4. Thereafter, when the reset rod 106 is lowered, the compensating bimetal 50 no longer influences the latch lever 68 and the spring 84 returns the lever to the position where, upon release of the reset rod, the detent 86 engages the surface 88, the serrated edges 110 and 112 disengage, and the spring 84 deflects the mounting arm 70 to the closed position of the movable contact 64 on the terminal straps or contacts 60, 62.

In addition to the foregoing, an adjusting screw 114 extends through the lower end of the latch lever 68 to regulate the relative movement between the latch lever and the crossbar 42 through the compensating bimetal 50. Moreover, the crossbar 42 includes a projection 116 for providing a single point contact with the center bimetal element 26. In order to provide an identical relationship between the crossbar 42 and the other bimetal elements 24, 28, during assembly, the relay 10 is turned so that the crossbar is disposed above the bimetal element 24, 26, 28 with the projection 116 in contact with the center bimetal element 26. Thereafter, two pins 118 and 120 are dropped through holes 122 and 124, respectively, which pins come to rest upon their corresponding bimetal elements 24, 28 and are then cemented in place within the holes 122, 124, thus locating the crossbar in identical relationship with the three bimetal elements.

In conclusion, a more economical thermal overload relay is provided in that, among other things, a single integral housing having no separable parts and comprising openings or bores into which operating parts of the bimetal are slidably mounted, that the crossbar and reset rod are assembled in a snap-fit placement during assembly, that the bimetal elements are mounted in a suspended condition, and that the operating parts of the movable contact are provided with a trip-free resetting construction.

What is claimed is:

1. An electrical control device comprising a housing, a stationary contact, a movable contact, a slide within the housing for moving the movable contact between open and closed positions, a movable contact mounting arm on the slide, latch means on the slide for latching the slide in one of said positions, the slide being spring-biased in the other position, manual reset means for moving the slide to the latched position and comprising a reset rod, a plurality of pole units, each pole comprising a bimetal element responsive to current flow to effect heating thereof, and a crossbar associated with the bimetal elements to effect unlatching of the latch means.

2. The electrical control device of claim 1 in which the mounting arm is a pivotally mounted lever.

3. The electrical control device of claim 1 in which the latch means comprises a latch lever having a detent releasably latching the slide in said one position.

4. The electrical control device of claim 3 in which the latch lever is moved to an unlatched position of the detent by the crossbar when the bimetal element is heated.

5. The electrical control device of claim 4 in which the contacts are in the closed position when the latch lever is in the latched position, and the slide is biased in the open position.

6. The electrical control device of claim 5 in which the mounting arm and the latch lever are mounted at spaced locations on the slide, and a bias spring is disposed between the arm and lever.

7. The electrical control device of claim 6 in which the manually movable reset rod has one end engageable with the mounting arm to effect movement of the slide to a position where the detent is latched.

8. The electrical control device of claim 7 in which an inclined surface is disposed in the path of travel of the pivotally mounted lever to effect movement of the movable contact from the stationary contact when the slide moves to the open position.

9. The electrical control device of claim 8 in which the mounting arm in the open position is in the path of travel of the reset rod to enable movement of the arm to a reset position.

10. The electrical contact device of claim 8 in which engaging surfaces of the reset rod and the mounting arm are interlocked to effect non-contact of the stationary and movable contacts when the detent is prevented from relatching by the crossbar.

11. The electrical contact device of claim 1 in which the housing is an integral signal unit into which the several elements of the device are inserted in place.

* * * * *